United States Patent [19]

Wood

[11] 3,935,796

[45] Feb. 3, 1976

[54] VARIABLE HYDRAULIC PUMPING APPARATUS

[75] Inventor: Robert A. R. Wood, West Vancouver, Canada

[73] Assignee: Teleflex Incorporated, North Wales, Pa.

[22] Filed: Apr. 16, 1974

[21] Appl. No.: 461,355

[52] U.S. Cl. ..... 92/12.2; 91/504

[51] Int. Cl.² ..... F01B 3/00

[58] Field of Search ..... 91/504, 505, 506; 417/222, 417/269; 92/12.2

[56] References Cited

UNITED STATES PATENTS

| | | | |
|---|---|---|---|
| 2,345,446 | 3/1944 | Baker | 91/505 |
| 2,842,068 | 7/1958 | Sundin | 417/269 |
| 3,266,434 | 8/1966 | McAlvay | 417/222 |
| 3,739,691 | 6/1973 | Bobier | 91/506 |
| 3,803,987 | 4/1974 | Knapp | 91/506 |

*Primary Examiner*—William L. Freeh
*Assistant Examiner*—G. P. LaPointe
*Attorney, Agent, or Firm*—McGlynn and Milton

[57] ABSTRACT

A hydraulic pumping apparatus including a cylindrical housing member having an open upper end closed by a cover held in place by a snap ring. A rotor is rotatably supported in the housing and in turn supports a plurality of pistons which are parallel to the axis of rotation of the rotor. The novelty resides in the swash plate assembly which includes an off-the-shelf bearing comprising two parallel plates with all bearings sandwiched therebetween with one of the plates engaging the pistons. An integral plastic ring member is disposed within the annular opening of the upper thrust plate of the bearing assembly and includes trunnions extending laterally in opposite directions for disposition in grooves in the cover member for changing the angle of inclination of the bearing assembly. An adjustment member extends through the cover for engaging the upper thrust plate of the bearing assembly to change the angle of the inclination thereof.

10 Claims, 9 Drawing Figures

Figure 1:
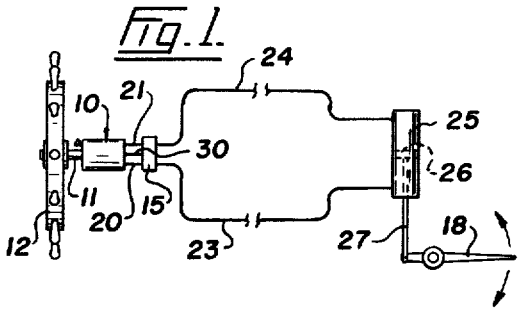

24
21
10
25
30
26
11
15
20
12
23
27
18

110
3
11
115
44
102
10
39
37
107
108
116
96
6
93
99
6
88
85
38
105
87
92
89
106
90
4
56
56
4
54
50
53
53
35
58
46
55
65
48
58
55
75
67
76
5
5
72
81
68
77
71
80
36
70
62
63
79
20
3
30
21

Fig. 6.
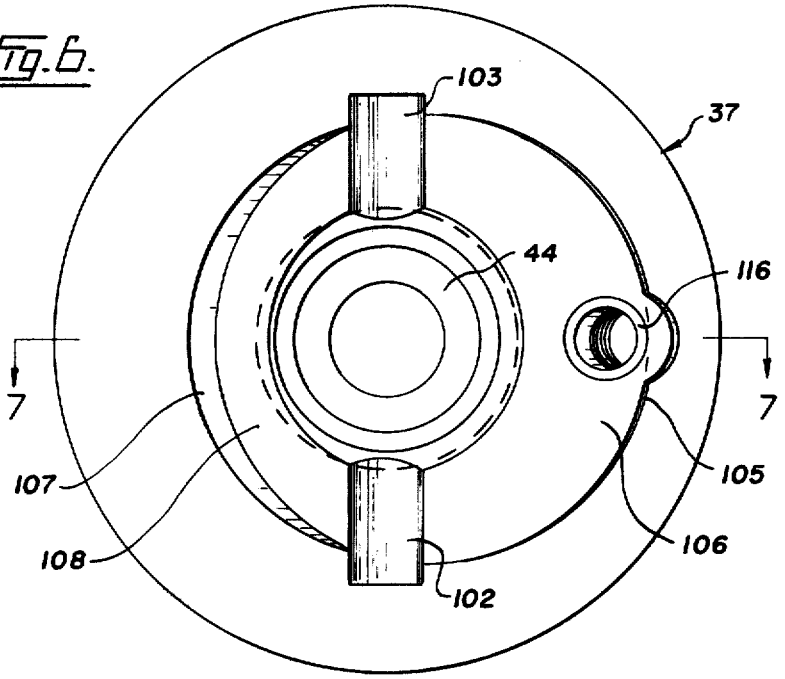
Fig. 7.
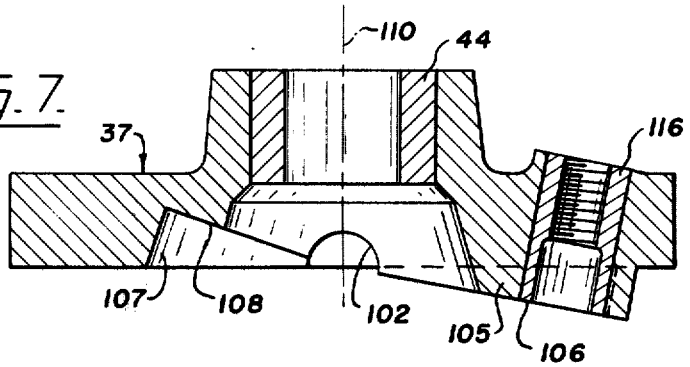
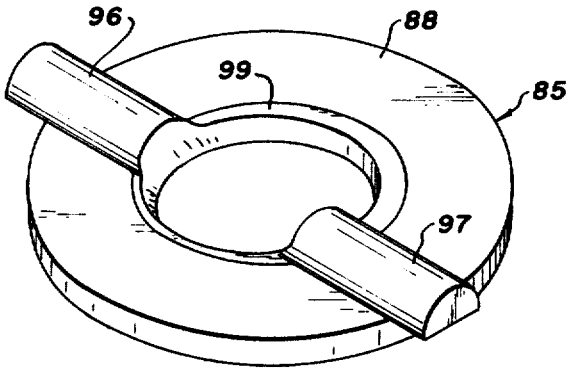
Fig. 8.

VARIABLE HYDRAULIC PUMPING APPARATUS

This invention relates to hydraulic pumping apparatus particularly for the steering systems of marine craft, but which may be used for other purposes as well.

As the present pumping apparatus has been designed particularly for use in the steering system of a boat, it will for the sake of convenience be so described herein, but it is to be understood that the invention is not to be limited to this field.

Ordinarily, when a hydraulic steering system of the prior art is to be installed in a boat, you select the number of turns you want the steering wheel to make when turning the rudder from port hardover to starboard hardover. For a given number of turns of the wheel you have either easy steering in calm conditions and hard steering in rough weather, or vice versa. If a compromise is made, as is usually done, you have to turn the steering wheel too many times under easy conditions, and have difficulty in turning the wheel in extremely bad conditions. Furthermore, with the known systems you cannot change to quick steering when you want it, such as, for example, when coming in to a dock.

The main purpose of this invention is to eliminate these problems. Steering apparatus incorporating the present invention is such that the number of turns between port hardover and starboard hardover can be quickly and easily adjusted while the system is in operation. With this arrangement, you can have a coarse adjustment, that is, relatively few turns of the steering wheel for fine weather steering, and fine adjustment for rough weather steering, with an infinite number of settings between these extremes.

The pumping apparatus in accordance with the present invention incorporates a swash plate pump which is operated by means of a steering wheel as the latter is turned in either direction to pump hydraulic fluid to either end of a slave cylinder for doing the required job, such as turning a vessel.

The pump has an inclined swash plate so mounted that its angle of inclination can be easily adjusted, and including means operable from outside of the pump for changing the angle of inclination. The swash plate is mounted so that its angle can be adjusted between about 10° to about 24° relative to a plane normal to the central axis of the pump mechanism. The fine setting is at 10° while the coarse setting is at 24°.

A feature of this invention is that the swash plate is in the form of a thrust bearing having ball bearings between two thrust plates. The swash plate pump includes the usual plunger pumps, and the plungers of these are retained against one of said thrust plates, while the other of the thrust plates is provided with a ring member having trunnions projecting laterally therefrom and operating in corresponding bearing grooves in the pump unit. These trunnions provide relatively large bearing surfaces to take the thrust of the plunger pumps. The thrust bearing is a standard bearing, and the ring member and trunnions form a unitary member made of plastic which can be easily manufactured by injection moulding or by die casting without any additional machining, this unitary member being readily attached to one of the thrust plates of the bearing.

Figure 2:
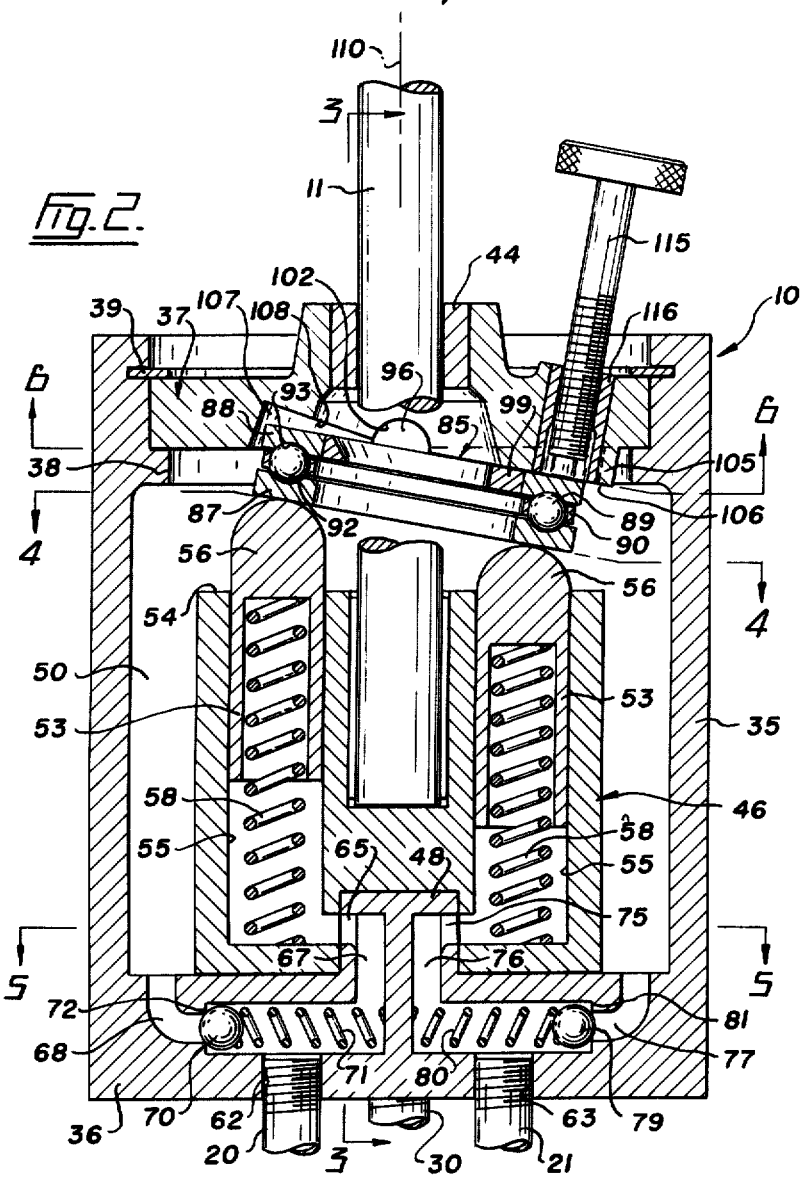
Figure 3:
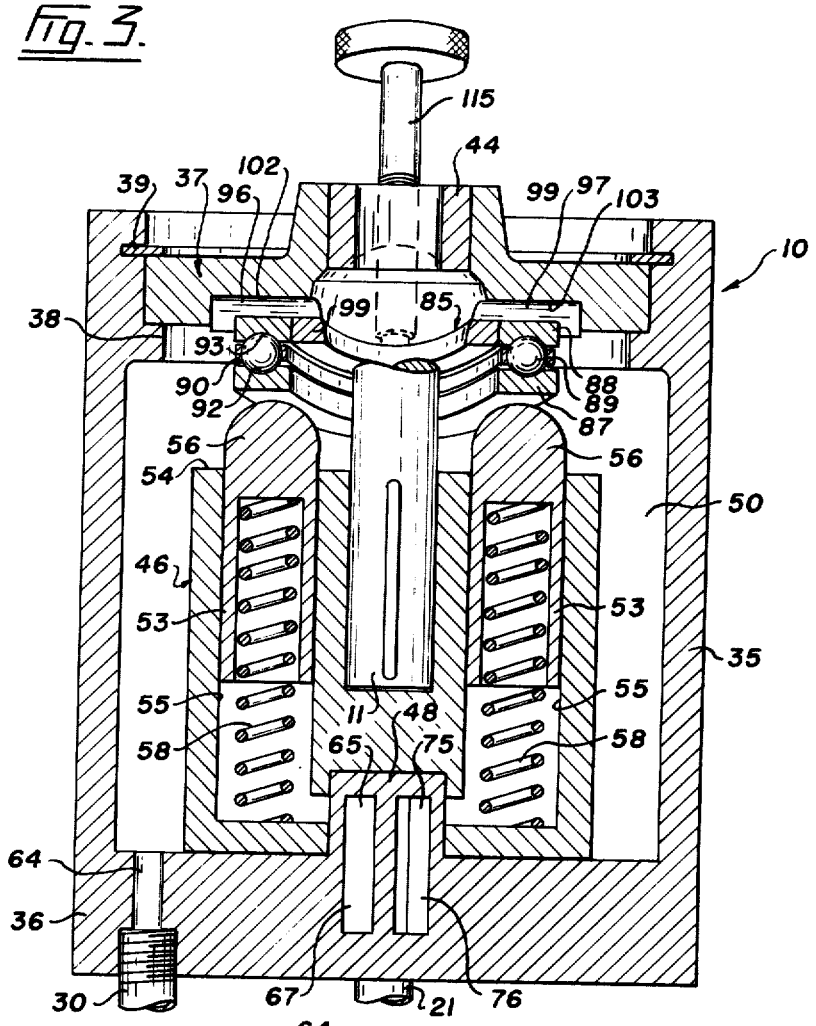
Figure 4:
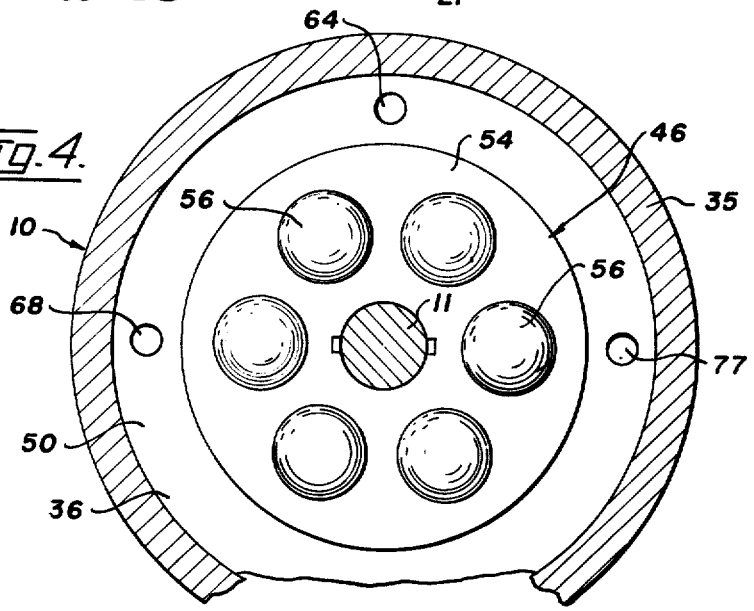
Figure 5:
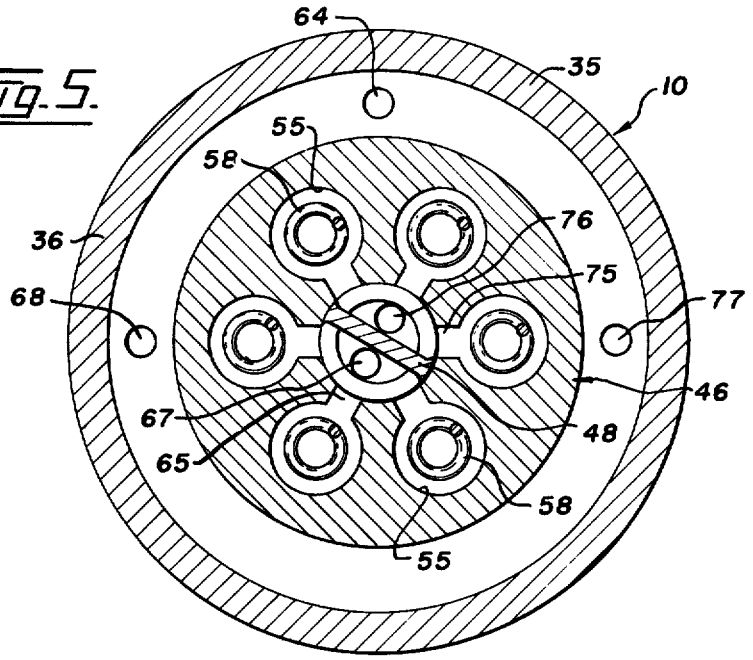
Figure 9:
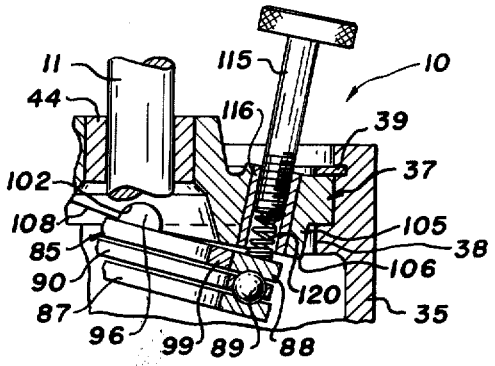

Examples of this invention are illustrated in the accompanying drawings, in which FIG. 1 is a diagrammatic view of a steering system incorporating the hydraulic pumping apparatus of this invention, FIG. 2 is an enlarged vertical section through this hydraulic pumping unit, and showing two pumps with the plungers thereof at opposite ends of their strokes, FIG. 3 is a vertical section taken on the line 3—3 of FIG. 2, and showing two pumps with their plungers midway between the ends of the strokes thereof, FIG. 4 is a horizontal section taken on the line 4—4 of FIG. 2, FIG. 5 is a horizontal section taken on the line 5—5 of FIG. 2, FIG. 6 is a substantially horizontal section taken on the line 6—6 of FIG. 2, FIG. 7 is a section taken on the line 7—7 of FIG. 6, FIG. 8 is a perspective view of the thrust plate of the swash bearing with the trunnions attached thereto, and FIG. 9 is a fragmentary sectional view of an alternative device for adjusting the angle of the swash plate.

Referring to the drawings, FIG. 1 diagrammatically illustrates a hydraulic pumping unit 10 in accordance with this invention mounted in a steering system of a boat. The unit 10 has a control shaft 11 projecting from one end thereof and upon which a steering wheel 12 is fixedly mounted. In this example, pumping unit 10 is used in association with a hydraulic control unit 15 of the type illustrated in U.S. Pat. No. 3,576,192, dated Apr. 27, 1971. This control unit includes a valve system for controlling the flow of hydraulic fluid to turn a rudder 18 in accordance with the direction of rotation of wheel 12. However, it is to be understood that the unit 15 can be incorporated in pumping unit 10, or other suitable directional control means may be used in or with unit 10. In this example, pressure lines 20 and 21 extend between units 10 and 15, while pressure-suction lines 23 and 24 extend between unit 15 and opposite ends of a slave cylinder 25 which has a piston 26 connected to rudder 18 by a link 27. A return line 30 extends between units 10 and 15.

Pumping unit 10 is designed to act as a reservoir for the hydraulic fluid so that return line 30 is connected to said unit, but it is to be understood that a separate reservoir may be employed, in which case return line 30 would extend from unit 15 to that reservoir, and another line would extend from the reservoir to unit 10.

Referring to FIGS. 2 to 8, pumping unit 10 includes a cylindrical housing 35 and having a wall 36 at one end and a cover or wall 37 at the opposite end. Wall 37 is seated on an annular shoulder 38, and is removably retained in position in any suitable manner, such as by a circlip 39.

Control or steering shaft 11 is journalled in a bearing 44 mounted in cover 37, and extends into housing 35 where it is fixedly secured to a rotor 46 rotatably mounted in the housing. Rotor 46 is rotatably mounted on a spigot 48 projecting inwardly from end wall 36 centrally thereof, and bears against the inner surface of said end wall. By referring to FIGS. 2 and 3, it will be seen that housing 35 is larger in diameter than rotor 46 to form therebetween a reservoir 50.

A plurality of pumps 53 are mounted in rotor 46 and project from an end 54 thereof. Each of these pumps consist of a bore 55 having a plunger or piston 56 slidably mounted therein and projecting outwardly from end 54 of the rotor. A spring 58 mounted in each bore 55 resiliently urges the plunger 56 of that bore outwardly relative to the rotor. The plungers of pumps 53 are sequentially reciprocated to draw in hydraulic fluid from reservoir 50 and to direct this fluid out through pipe 20 or 21, depending on the direction of rotation of the rotor.

In this example, end wall 36 is formed with outlet ports 62 and 63 with which pipe 20 and 21, respectively, communicate, and with an inlet port 64 with which return pipe 30 communicates. Spigot 48 is formed with a slot 65 opening out from one side thereof and long enough to be in communication with one half of the pumps 53 at a time. A passage 67 extends from this slot through the spigot and end wall 36 to outlet port 62. Another passage 68 in wall 36 extends from reservoir 50 to passage 67 and port 62. A check valve 70 is normally held by a spring 71 against a seat 72 in passage 68. Valve 70 normally closes passage 68 and opens towards the adjacent outlet port. Similarly, a slot 75 is formed in the side of spigot 48 and is long enough to communicate with one half of the pumps 53 at a time, and a passage 76 extends from this slot to outlet port 63. Another passage 77 extends from the reservoir to passage 76 and port 63. A check valve 79 is normally held by a spring 80 on seat 81 in passage 77. This valve normally closes passage 77 and opens towards port 63.

With this passage and port arrangement, when the plungers 56 of pumps 53 in communication with spigot slot 65 are moving upwardly, fluid is drawn from reservoir 50 through passages 68 and 67 into their respective bores 55. When the plungers of the pumps in communication with slot 65 are moved downwardly, the hydraulic fluid cannot flow back into passage 68 because of check valve 70 and therefore moves through passage 67 and port 62 into pipes 20. Similarly, when the plungers of pumps 53 in communication with slot 75 are moving upwardly, hydraulic fluid is drawn into the bores of these pumps from the reservoir through passages 77 and 76, and when the latter plungers are moved downwardly, this fluid is directed through passage 76 and port 63 into pipe 21. When shaft 11 is rotated in one direction, the plungers of the pumps in communication with slot 65 are moving upwardly and those in communication with slot 75 are moving downwardly, and when the shaft is rotated in the opposite direction this is reversed.

An inclined swash plate 85 is mounted in housing 35 between pumps 53 and cover 37. Although this may be a plate, it is preferably in the form of a thrust bearing made up of annular thrust plates 87 and 88 with ball bearings 89 in a race 90 therebetween. The balls run in opposed grooves 92 and 93 formed in the inner surfaces of these plates. Aligned trunnions 96 and 97 are connected to plate 88 and project laterally therefrom. In this example, the trunnions are formed of a suitable plastic material and are integrally connected with a ring 99 of the same material and which is fixedly secured within the opening in annular trhust plate 88. The trunnions extend outwardly from ring 99 over the outer surface of the thrust plate and project beyond the periphery thereof. Each of these trunnions is semi-circular in cross-section, as clearly shown in FIG. 8.

When thrust plate 88 is in position, trunnions 96 fit in corresponding grooves 102 and 103 formed in the inner surface of cover or end wall 37, see FIGS. 2 and 6. As the thrust plate is inclined, cover 37 is formed with a projection 105 on its inner surface near an edge thereof and having an inclined inner surface 106. This projection is located on one side of grooves 102 and 103, and on the opposite side thereof, the cover is formed with a recess 107 having an inclined bottom 108. By referring to FIG. 7, it will be seen that the surface 106 of projection 105 is inclined at a shallow angle relative to central axis 110 around which shaft 11 and rotor 46 rotate. The angle of bottom 108 is steeper relative to said axis than that of the projection inclined surface 106.

The assembled swash plate 85 is held in position with its trunnions 96 and 97 in grooves 102 and 103 by plungers 56 which are resiliently urged against the outer surface of thrust plate 87 by springs 58. When thrust plate 88 bears against the inclined surface 106 of projection 105, the thrust plate lies at a rather shallow angle relative to a plane normal to the axis 110, for example, 10°. Suitable means is provided for changing the angle of incline of the thrust plate relative to the axis. In FIGS. 2 and 3, a bolt 115 is threaded in a sleeve 116 fixedly mounted in and extending through cover 37 and its projection 105. This bolt is inclined relative to the axis 110 so that it is substantially normal to the swash plate. When bolt 115 is screwed inwardly, the swash plate rotates on its trunnions with the side thereof remote from the bolt moving towards the inclined bottom 108 of recess 107. This bottom limits the amount of movement of the swash plate under the action of the bolt, and at this time the swash plate lies at an angle of about 24° to a plane normal to axis 110. When the bolt is unscrewed, springs 58 through plungers 56 cause the swash plate to follow the bolt so that the angle of the plate is changed.

By referring to FIG. 2, it will be seen that trunnions 96 and 97 are located on axis 110, and that they are not on a diameter of the thrust bearing or plate so that a larger portion of the latter is on one side of said trunnions than on the other side thereof. This results in one or two more of the pump plungers bearing against the swash plate on one side of said trunnions than on the other side thereof. This almost balances the force pressing against the inclined plate on opposite sides of the trunnions so that not much effort is required to turn bolt 115, and yet there is sufficient additional force against the bolt side of the plate to cause it to follow any outward movement of the bolt.

The operation of pumping unit 10 is relatively simple. When steering wheel 12 is rotated, shaft 11, which extends freely through thrust plate 85, turns rotor 46 to cause pumps 53 to move around central axis 110. As the plungers 56 are bearing against the inclined swash plate 85, each plunger is reciprocated to and fro once during each revolution of the rotor and, consequently, the steering wheel. The amount of hydraulic fluid moved by the pump during each revolution depends upon the angle of the swash plate. When the swash plate is at the angle illustrated in FIG. 2, its minimum angle, it requires several turns of wheel 12 to pump enough fluid into slave cylinder 25 to move rudder 18 from port hardover to starboard hardover. This is similar to operating a motor vehicle in low gear, and the rudder can be turned very easily in heavy seas. If it is desired to change the setting, it is only necessary to screw bolt 115 inwardly to steepen the angle of the swash plate. As this is done, more fluid is pumped during each revolution of the steering wheel and so fewer turns are required to move the rudder from one extreme position to the other. When the swash plate reaches the inclined bottom 108 of recess 107, the minimum number of turns is required for moving the rudder, and this setting can be used in calm weather.

Some of the advantages of this invention are as follows:

1. The thrust bearing is used as a swash plate. If a plate were provided it would anyway be desirable to have a thrust bearing between it and the plunger pumps. In addition, a standard thrust bearing is used for this purpose.
2. It is a simple matter to manufacture and mount trunnions 96 and 97 with their ring 99. The trunnions and ring can be made of suitable plastic material either by injection moulding or die casting, and ring 99 is secured in thrust plate 88 with the flat surfaces of the trunnions bearing against the flat surface of the plate so that the trunnions are braced by the latter and are not subjected to any bending action.
3. As will be noted from FIGS. 6 and 8, the trunnions and the grooves in which they fit are relatively long so as to provide large bearing surfaces for supporting the swash plate against the considerable pressure of the springs of the plunger pumps.
4. The swash plate is substantially balanced owing to the position of its trunnions and therefore the adjusting screw is under very light load and can easily be turned to change the angle of the swash plate regardless of steering conditions. Thus, a person can quickly and easily adjust the number of turns of the steering wheel required to move the rudder back and forth to suit rough or calm conditions or different situations when it is required to manoeuver the boat rapidly. The ratio of the turns of the steering wheel to the movement of the rudder can be readily adjusted.

FIG. 9 illustrates an alternative form of adjusting means for pumping unit 10. In this example, a spring 120 is interposed between bolt 115 and swash plate 85. With this arrangement, if there is relatively great back pressure from the rudder, as is the case in heavy seas, this increase in back pressure will cause the swash plate to compress spring 120 to a limited degree so that the angle of the plate is changed to a finer one for easier steering. This tends automatically to relieve the effort necessary for steering the boat.

I claim:

1. A hydraulic apparatus comprising: housing means, rotor means rotatably supported in said housing means for rotation about an axis, piston means movably supported by said rotor means and extending from said rotor means axially thereof, swash plate means movably supported by said housing means and engaging said piston means for controlling the length of stroke of said piston means per revolution of said rotor means, said swash plate means including a bearing assembly disposed about said axis and including parallel upper and lower plates with ball bearings disposed, therebetween, said plates being annular to define a central opening, a ring member disposed in engagement with said bearing assembly and having a body portion disposed in said opening therein, said ring member having arcuate trunnions integral with said body portion and extending laterally from said body portion in opposite directions transversely to said axis and across said upper plate, said housing means including grooves for receiving and rotatably supporting said trunnions to change the angle of inclination of said bearing assembly for controlling said length of stroke.

2. An apparatus as set forth in claim 1 wherein said ring member is made of plastic.

3. An apparatus as set forth in claim 1 wherein said housing means includes a separate cover defining an end wall adjacent said ring member, said grooves for receiving said trunnions being disposed in said cover.

4. An apparatus as set forth in claim 3 wherein said housing means includes a cylindrical housing member open at a first end thereof, said housing member having a shoulder adjacent said first end, said cover abutting said shoulder.

5. An apparatus as set forth in claim 4 including a snap-ring engaging said housing member and said cover for retaining said cover against said shoulder.

6. An apparatus as set forth in claim 3 wherein said cover includes an inclined recess adjacent said grooves for accommodating movement of said bearing assembly.

7. An apparatus as set forth in claim 3 including adjustment means supported by said cover and engaging one of said plates.

8. An apparatus as set forth in claim 7 wherein said adjustment means includes a sleeve fixed to said cover and including a threaded bore and an adjusting bolt threadedly engaging said bore of said sleeve.

9. An apparatus as set forth in claim 1 wherein each of said trunnions has a flat bottom surface extending across and engaging said upper plate.

10. An apparatus as set forth in claim 9 wherein said unitary member is made of plastic.

* * * * *